US007097507B1

(12) United States Patent
Zhang et al.

(10) Patent No.: US 7,097,507 B1
(45) Date of Patent: Aug. 29, 2006

(54) ELECTRICAL CONNECTOR WITH IMPROVED SHELL

(75) Inventors: George Huanyi Zhang, Irvine, CA (US); Zhi-Kai Guo, ShenZhen (CN); Lin Huang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/144,095

(22) Filed: Jun. 2, 2005

(51) Int. Cl.
*H01R 13/648* (2006.01)

(52) U.S. Cl. ..... 439/609; 439/95; 439/939

(58) Field of Classification Search ..... 439/92, 439/95, 607, 609, 939
See application file for complete search history.

(56) References Cited

U.S. PATENT DOCUMENTS 5,752,854 A * 5/1998 Capp et al. ..... 439/607
6,149,444 A * 11/2000 Shi et al. ..... 439/95
6,319,061 B1 * 11/2001 Chen et al. ..... 439/607
6,343,941 B1 * 2/2002 Kan ..... 439/95
6,683,796 B1 * 1/2004 Radu et al. ..... 361/818
6,948,984 B1 * 9/2005 Chen et al. ..... 439/660

FOREIGN PATENT DOCUMENTS

CN 3396156 10/2004
TW 101170 11/2004

* cited by examiner

*Primary Examiner*—James R. Harvey
(74) *Attorney, Agent, or Firm*—Wei Te Chung

(57) ABSTRACT

An electrical connector (100) comprises an insulative housing (1), a plurality of contacts (2) assembled to the insulative housing (1), and a shell (3) having at least a spring piece (31) with at least a protrusion projected outward. With the set of the protrusion, the electrical connection between the electrical connector (100) and a chassis panel may be improved and reliable.

19 Claims, 8 Drawing Sheets

ELECTRICAL CONNECTOR WITH IMPROVED SHELL

BACKGROUND OF THE INVENTION

1. Field of the Invention

The present invention relates generally to an electrical connector, and more particularly to a single lane external serial ATA data interface.

2. Description of the Prior Art

There exists in the art an electrical connector known as External Serial ATA connector which is generally used for transmitting high speed signals between storage devices and a motherboard. Because of many advantages superior to Parallel ATA, Serial ATA replaces Parallel ATA gradually and becomes the next transmitting generation.

A serial ATA right angle plug is disclosed in FIG. 11, which comprises a shell 10 having a top and bottom plates 11, 12. A pair of spring piece 13, 14 vertically extend from front edges of the top and bottom plates 11, 12, respectively. There are provided a pair of elastic tabs 131, 141 at distal ends of each spring piece 13, 14 to press against a chassis panel. The electrical connection between the electrical connector and the chassis panel depends on press points, and only two pairs of press points are formed in this connector, therefore, the electrical connection there between may not be reliable.

BRIEF SUMMARY OF THE INVENTION

It is an object of the present invention to provide an electrical connector having an improved shell, which electrically connects with a chassis panel reliably.

In order to achieve the object set forth, an electrical connector adapted for mounting to a panel comprises an insulative housing, a plurality of contacts assembled to the insulative housing, a shell assembled to the insulative housing and having at least a spring piece with at least a protrusion projected outward there from adapted for electrically connecting with the panel.

Additional novel features and advantages of the present invention will become apparent by reference to the following detailed description when taken in conjunction with the accompanying drawings.

DETAILED DESCRIPTION OF PREFERRED EMBODIMENTS

Figure 1:
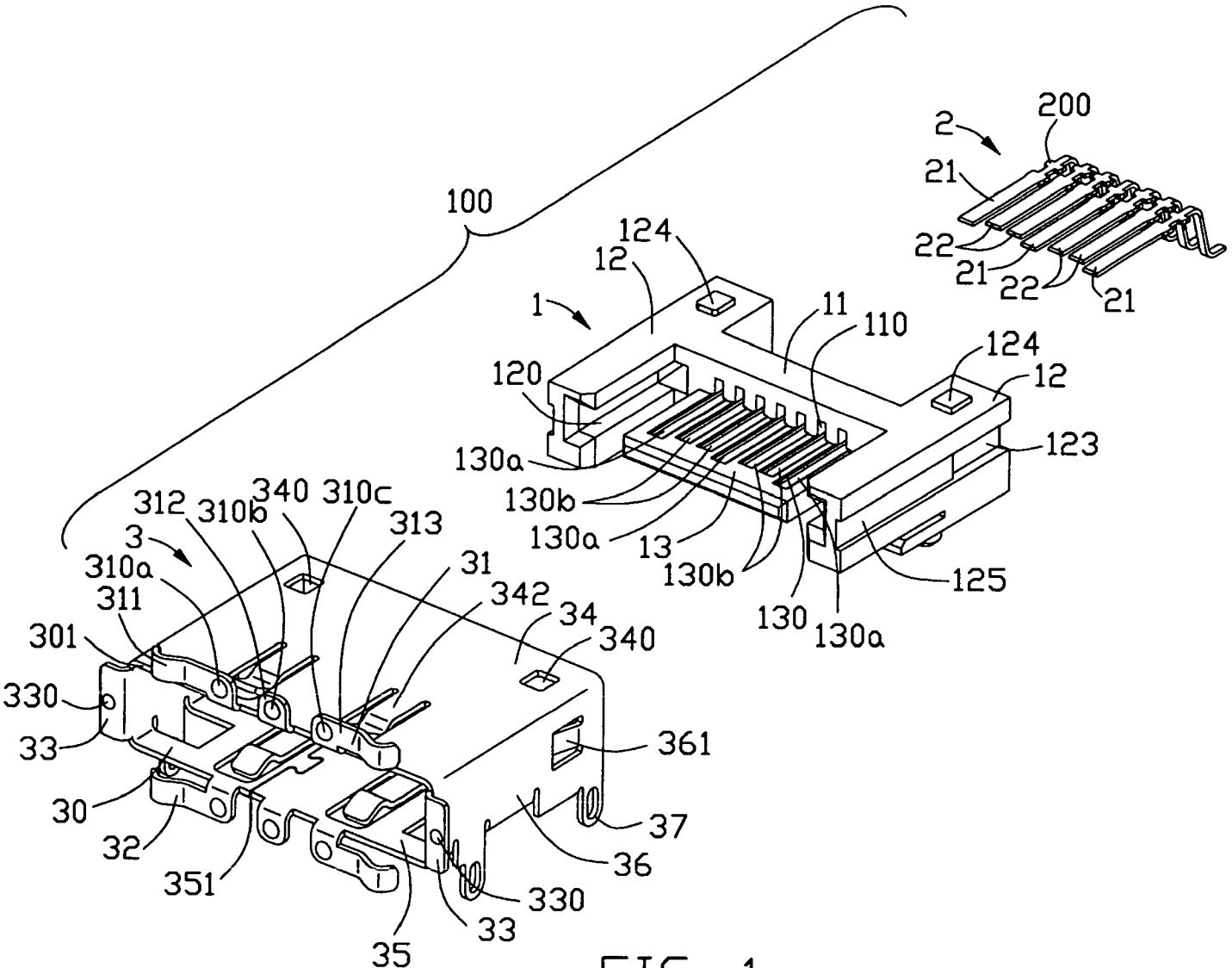
FIG. 1 is an exploded view of an electrical connector in accordance with a preferred embodiment of the present invention.
Figure 2:
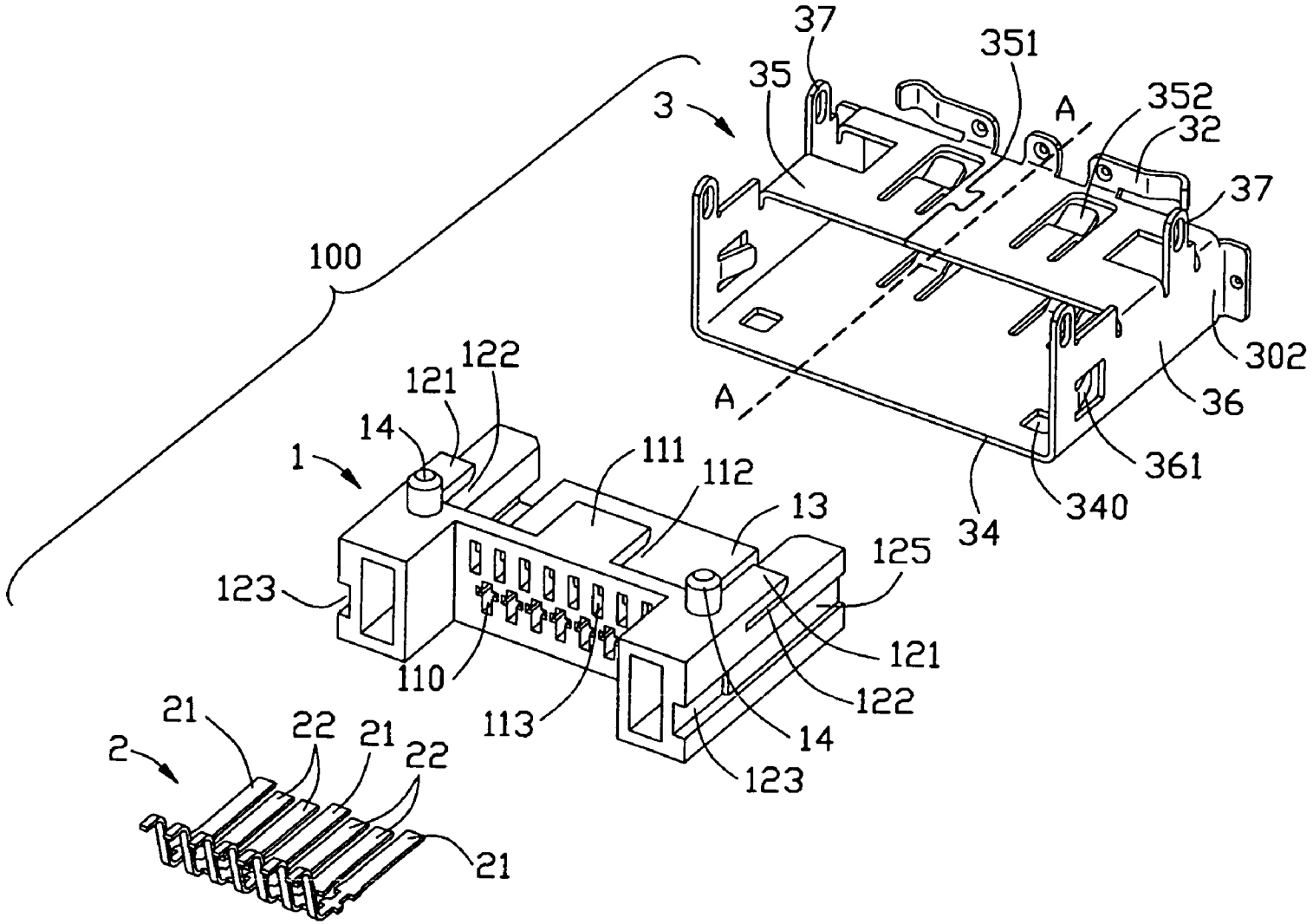
FIG. 2 is a view similar to FIG. 1, from a different aspect.
Figure 3:
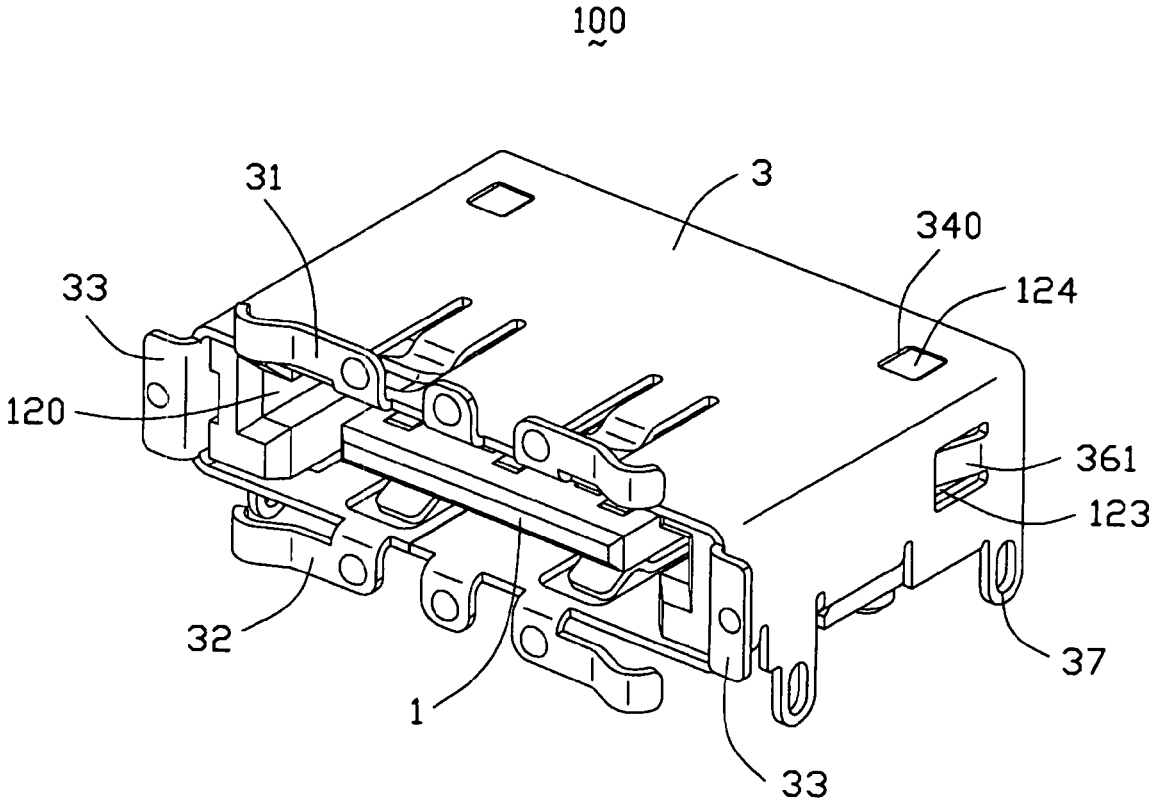
FIG. 3 is an assembled view of the electrical connector of FIG. 1.

Referring to the drawings in great detail, and first to FIGS. 1 to 4, the invention is directed to an electrical connector 100 which includes a shell 3 enclosing an insulative housing 1, a plurality of contacts 2 inserted into the insulative housing 1 of the electrical connector 100.

Figure 4:
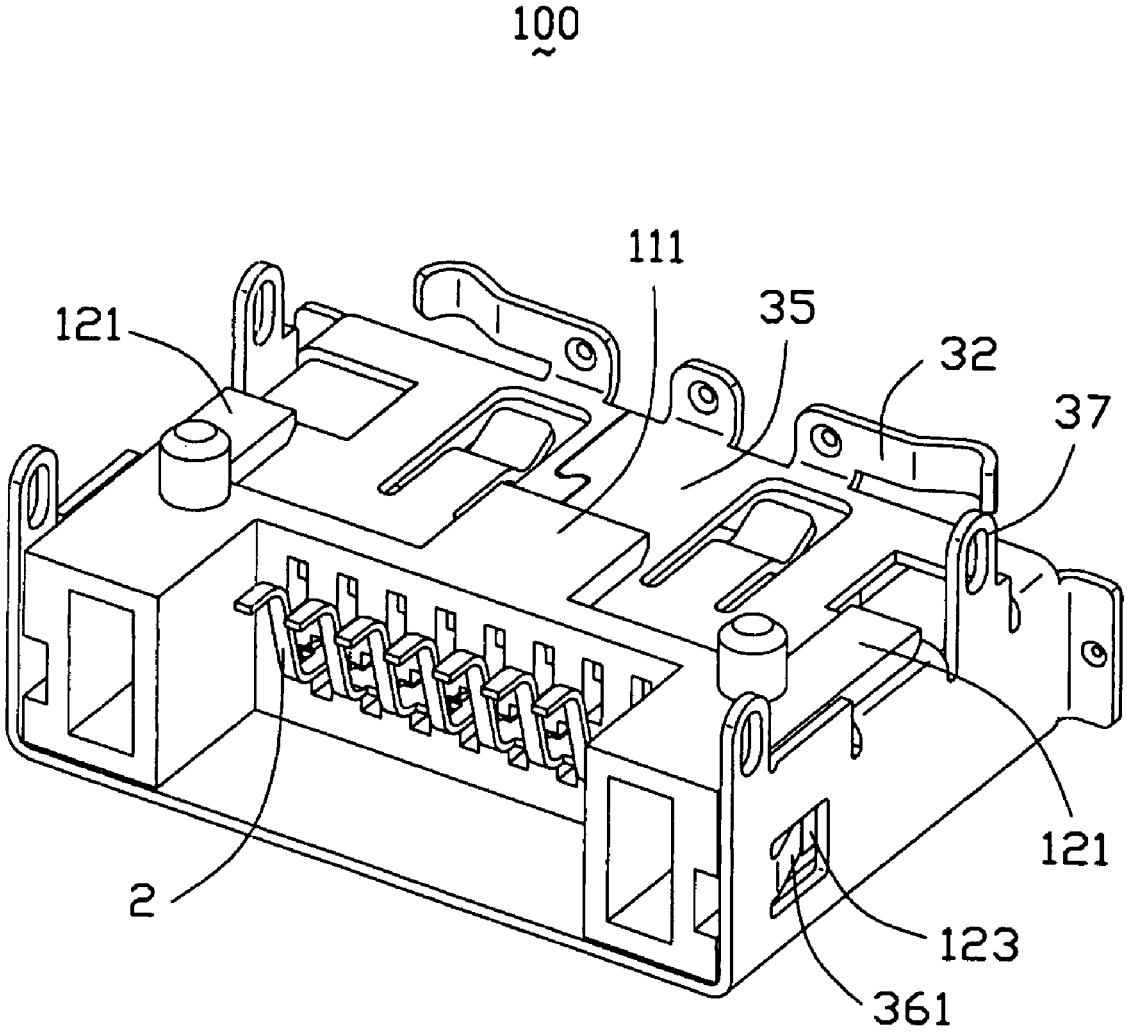
FIG. 4 is an assembled view of the electrical connector of FIG. 2.

The insulative housing 1 comprises a base portion 11, a pair of opposite lateral portions 12 positioned at transverse ends of the base portion 11 and a tongue portion 13 extending forward from the base portion 11. A row of passageways 110 are defined through the base portion 11 along a front-to-back direction and each is shaped as a cross. The tongue portion 13 defines a plurality of slots 130 therein communicating with the passageways 110, respectively. The contacts 2 relating to grounding contacts 21 and signal contacts 22 are inserted into the respective slots 130. The length of the slots 130*a* receiving the grounding contacts 21 is greater than that of the slots 130*b* receiving the signal contacts 22. The lateral portions 12 of uniform configuration have guiding channels 120 recessed outwardly from inner surfaces thereof for incepting a mating connector (not labeled) and leading channels 125 recessed inwardly from outer surfaces thereof for guiding the shell 3 assembled to the insulative housing 1. A pair of recess sections 123 are recessed inwardly from outer surfaces of lateral portions 12 and locate in rear of the leading channels 125 for engagement with an elastic tab 361 of the shell 3. A pair of projecting sections 124 are formed on the top surfaces of the lateral portions 12 and positioned on the rear of the lateral portions 12. In the middle of the base portion 11, there is provided a flat board 111 extending forward there from. A receiving space 112 is formed between a bottom surface of the tongue portion 13 and the flat board 111. In addition, a pair of flat plates 121 extending forwardly from respective lateral portions 12 are provided, and thus, a receiving area 122 is formed between corresponding flat plate 121 and a bottom surface of the lateral portion 12 to communicate with the receiving space 112. The receiving space 112 and the receiving area 122 are used for the insertion of the shell 3 (as shown in FIG. 4) so as to prevent the movement of the insulative housing 2 and the shell 3 relative to each other. There are aligned grooves 113 at equal intervals in lengthwise direction and located above the passageways 110. A pair of posts 14 are projected from bottom surfaces of corresponding lateral portions 12 for positioning the electrical connector 100 on printed circuit board (not shown).

The contacts 2 comprise the grounding contacts 21 and the signal contacts 22 as described above. The length of the grounding contacts 21 is greater than that of the signal contacts 22 in mating direction of the electrical connector 100. The differential in length makes an electrical connection between the grounding contacts 21 and terminals of a complementary connector (not shown) relatively earlier so as to insure the electrical connector 100 perform reliably. Each contact 2 has a cross section 200 serving as an interference relative to the passageway 110.

The shield 3 defining a mating port, has generally upper and lower sections 34, 35 and a pair of opposite lateral sections 36 coupling the upper and lower sections 34, 35. These sections 34, 35, 36 cooperate to define a rectangular mating opening 30 with a pair of opposite lengthwise edges 301 and a pair of opposite widthwise edges. A first spring piece 31 extends upwardly from one lengthwise edge 301 as well as a second spring piece 32 extends downwardly from the other lengthwise edge 301. The first and second spring pieces 31, 32 are identical in structure except that the second spring piece 32 is inverted in relation to the first spring piece 31, therefore, only the first spring piece 31 will be described hereinafter in detail. The first spring piece 31 comprises a center section 312 positioned in the middle of the lengthwise edge 301 and a first and second stretch sections 311, 313 extending away from each other in opposite directions along the lengthwise edge 301. In order to increase and insure electrical contact between the shell 3 and a panel (not shown), bumps are stamped on the center section 312 and the stretch sections 311, 313. It can be seen clearly in FIG. 1, each section 311, 312, 313 has a respective protrusion, such as a bump 310*a*, 310*b*, 310*c* projecting outward there from. Additionally, a pair of resilient tabs (not labeled) are formed integrally with distal end of each stretch section 311, 313 to establish a secure electrical connection between the shell 3 and the panel. A pair of tabs 33 each with a bump 330 formed thereon extend laterally from the opposite widthwise edges, respectively. The lower section 35 has a swallow-tailed jointing seam 351, if we define a center line A—A on the lower section 35, the jointing seam 351 offsets from the center line A—A in order to leave a favorable position to form the center section 312 of the second spring piece 32. Two pairs of resilient arms 342, 352 are formed on the upper and lower sections 34, 35, respectively for engagement with a mating connector (not shown) and the insulative housing 2 of the electrical connector 100. A pair of apertures 340 are disposed on the rear of the upper section 34 for engaging with the projecting sections 124 of the insulative housing 1 so as to support the insulative housing 1 against movement relative to the shell 3, particularly in the mating direction. A pair of elastic tabs 361 positioned on respective lateral section 36 interfere with the insulative housing 1 to further prevent the movement between the insulative housing 1 and the shell 3. When the shell 3 is assembled to the insulative housing 1 in front-to-rear direction, the elastic tabs 361 slide along the leading channels 125 and engage with the recess sections 123 finally and the lower section 35 of the shell 3 received in the receiving space 112 and receiving area 122, and thus, secured between the flat board 111, the flat plates 121 and the tongue portion 13, lateral portions 12. The shell 3 has two pairs of tails 37 stamped from the lower section 35 to electrically couple the connector 100 with the printed circuit board. It can be understood that the spring piece 31, 32 is essentially of an L-shaped configuration with a narrow short section integrally from the edge section and a narrow long section integrally extending from the distal end of the short section.

Figure 5:
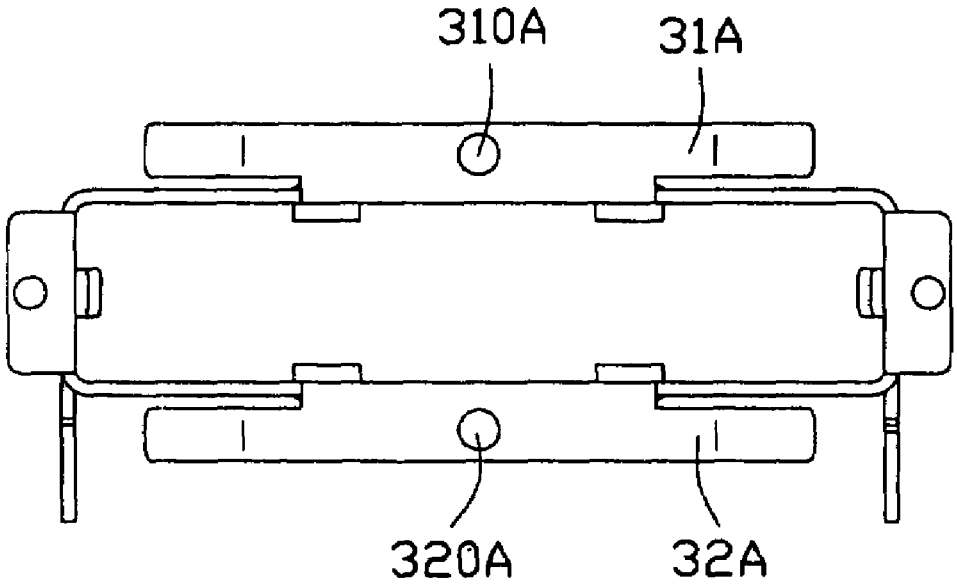
FIGS. 5–10 are front elevation views of a shell of the electrical connector with different spring pieces.
Figure 6:
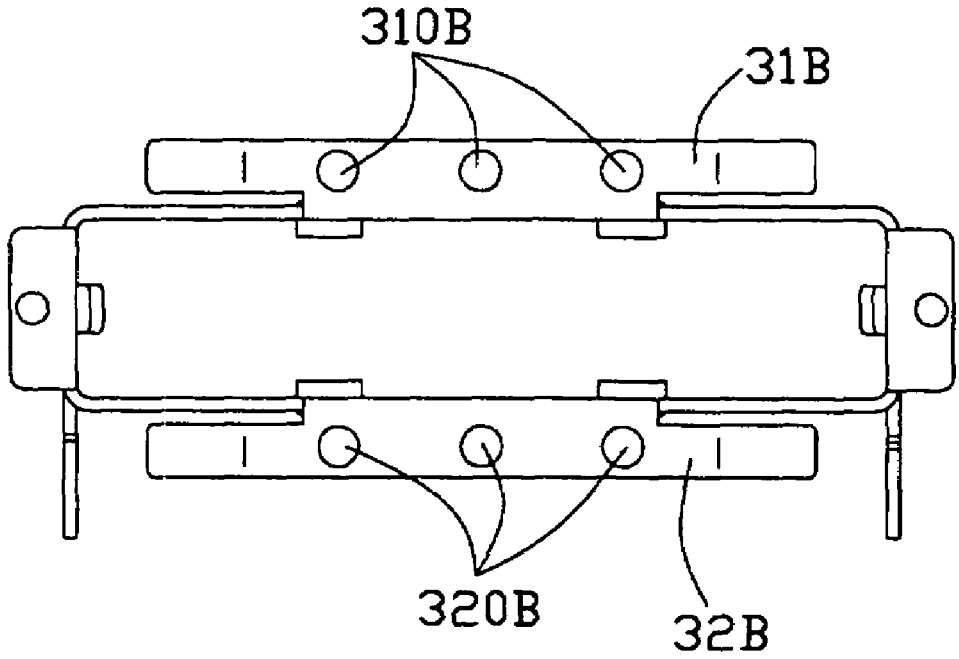
Figure 7:
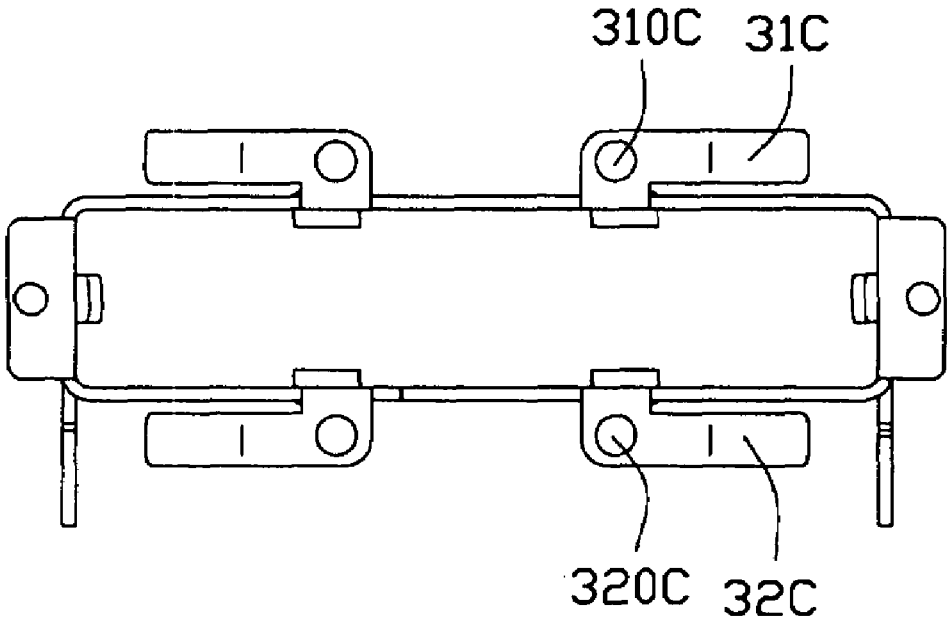
Figure 8:
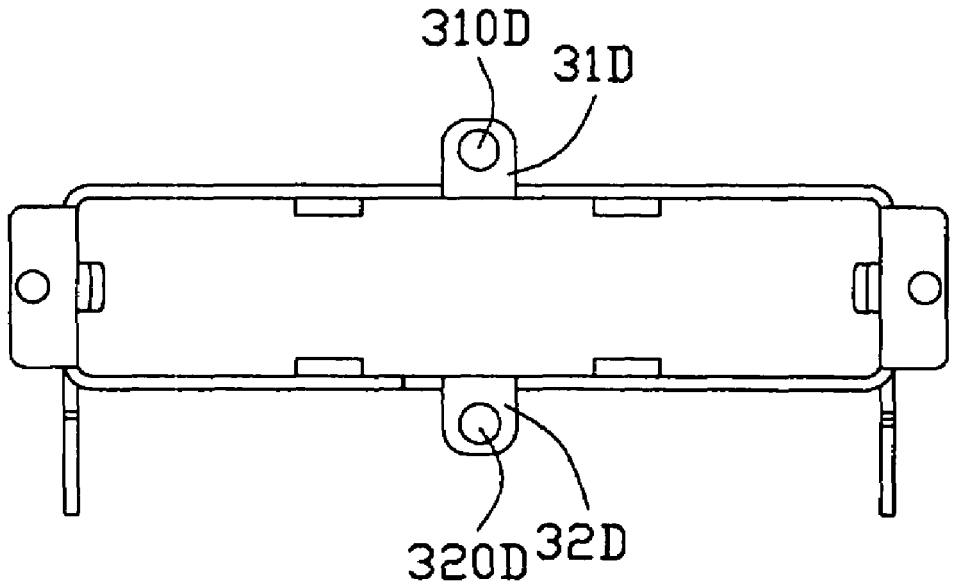
Figure 9:
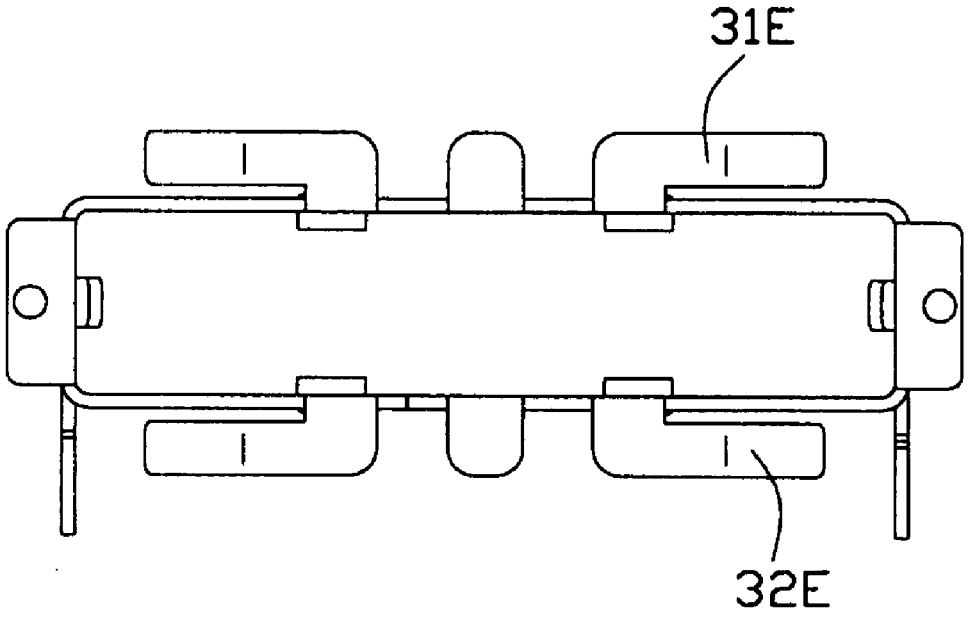
Figure 10:
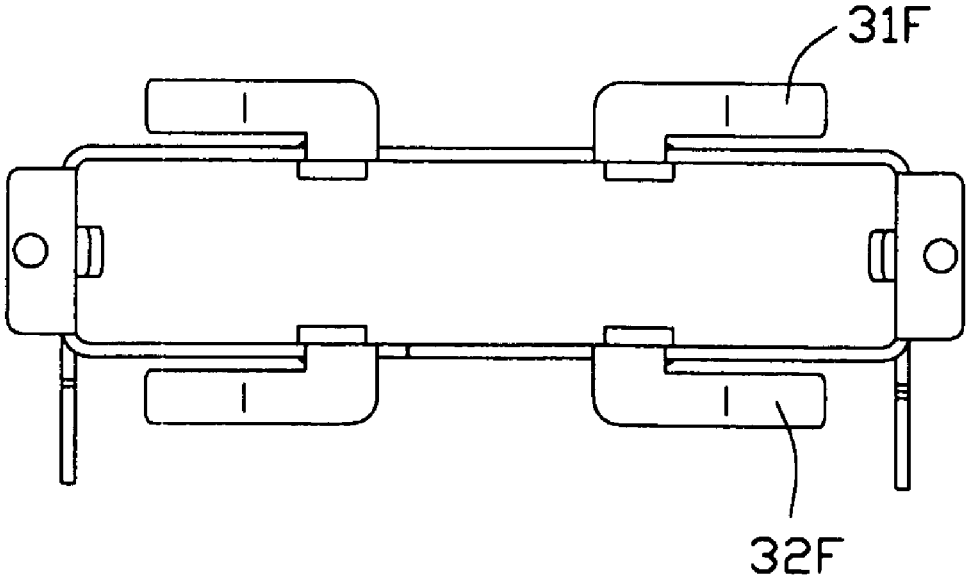
Figure 11:
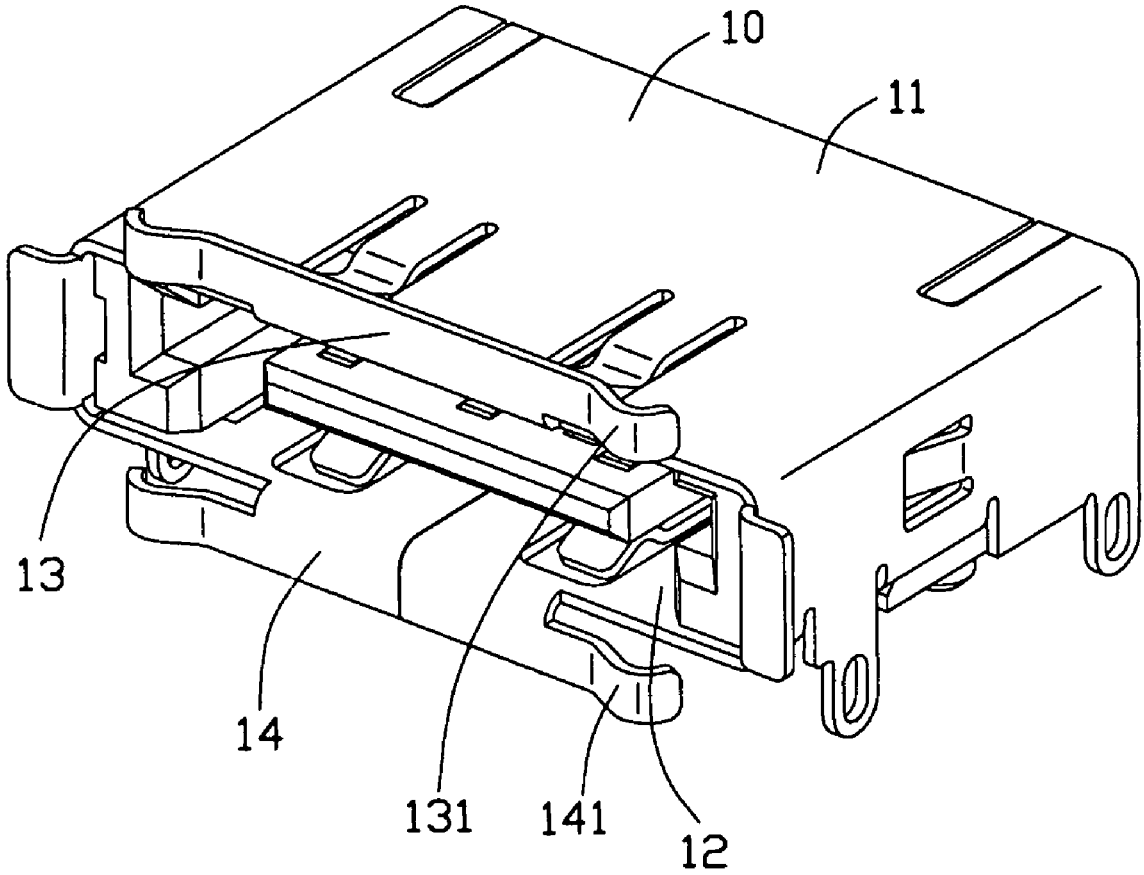
FIG. 11 (PRIOR ART)
FIG. 11 is a perspective view of a conventional electrical connector.

Spring pieces of the shell 3, may have different configurations as illustrated in FIGS. 5 to 10. FIG. 5 shows a pair of spring pieces 31A and 32A with bumps 310A, 320A respectively positioned thereon. FIG. 6 shows spring pieces 31B and 32B having identical structure with the spring pieces 31A and 32A and each having three bumps 310B, 320B positioned thereon. FIG. 7 shows two pairs of stretch sections 31C and 32C and each having a bump 310C and 320C positioned thereon. FIG. 8 shows a pair of center sections 31D and 32D and each having a bump 310D and 320D positioned thereon. FIG. 9 shows two spring pieces 31E, 32E with stretch sections and center sections and without bumps projected there from. FIG. 10 shows a pair of spring pieces 31F, 32F without bump projected there from and each comprising a pair of stretch sections.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An electrical connector adapted for mounting to a panel, comprising:

an insulative housing;

a plurality of contacts assembled to the insulative housing;

a shell assembled to the insulative housing and having at least a spring piece with at least a protrusion projected outward therefrom adapted for electrically connecting with the panel, wherein the shell has a lower section partially received in the insulative housing;

the insulative housing has a pair of flat plates and a pair of lateral portions, and wherein each flat plate and the corresponding bottom surface of the lateral portion together define a receiving area for receiving the lower section of the shell;

the insulative housing has a flat board coplanar to the flat plate and a tongue portion, and wherein the flat board and the bottom surface of the tongue portion together define a receiving space communicating with the receiving area for receiving the lower section of the shell.

2. The electrical connector as claimed in claim 1, wherein the protrusion is a bump.

3. The electrical connector as claimed in claim 1, wherein the shell comprises a mating opening having a plurality of edges, and wherein the spring piece extends outwardly from one edge of the opening.

4. The electrical connector as claimed in claim 1, wherein the mating opening has a pair of opposite lengthwise sides and the electrical connector further comprises a second spring piece with at least a protrusion projected outward therefrom, and wherein each spring piece extends from each lengthwise side.

5. The electrical connector as claimed in claim 4, wherein each spring piece comprises a first and second stretch sections symmetrical to each other, a center section positioned between the first and second stretch sections.

6. The electrical connector as claimed in claim 4, wherein the mating opening has a pair of opposite widthwise edges, and wherein the electrical connector further comprises a third and fourth spring pieces extending outward from the opposite widthwise sides, respectively.

7. The electrical connector as claimed in claim 1, wherein the shell has a lower section defining a center line extending along a front-to-back direction and a jointing seam substantially extending along a line offsetting from said central line of the lower section along a lateral direction, and wherein the spring piece has a center section extends downwardly from an end edge of the lower section adjacent to the central line.

8. The electrical connector as claimed in claim 7, wherein the spring piece further has a first and second stretch sections arranged in a line with the middle section.

9. The electrical connector as claimed in claim 8, wherein each stretch section has a resilient tab at distal end thereof.

10. The electrical connector as claimed in claim 1, wherein the spring piece has at least two stretch sections and each has at least a protrusion positioned thereon.

11. The electrical connector as claimed in claim 1, wherein the shell has a plurality of connecting tails for coupling to a printed circuit board.

12. The electrical connector as claimed in claim 1, wherein the insulative housing comprises a base portion and a pair of lateral portions located at the transverse ends of the base portion.

13. The electrical connector as claimed in claim 1, wherein the insulative housing comprises a tongue portion extends from the base portion and a plurality of slots fluted in the tongue portion for receiving the contacts.

14. An electrical connector comprising:

an insulative housing defining a mating port with a mating opening defined by longitudinal and vertical dimensions thereof;

a plurality of contacts received in the insulative housing;

a shell enclosing the insulative housing and defining at least one edge section around said mating port along a longitudinal direction of said mating port; and a pair of L-shaped spring pieces commonly extending from said at least one edge section under a mirror image arrangement with each other, said spring piece including a narrow short section integrally extending from the at least one edge section in a vertical direction, a narrow long section integrally extending from a distal end of the short section horizontally spatially along said at least one edge section along said longitudinal direction; wherein a first forwardly extending protrusion is formed around a joint portion of the short section and the long section, and a second forwardly extending protrusion is formed around a distal end of the long section; wherein said pair of L-shaped spring pieces are distanced from each other with a space therebetween essentially at a middle portion of said at least one edge section.

15. The electrical connector as claimed in claim 14, wherein said first forwardly extending protrusion is a bump with less compression while said second forwardly extend protrusion is essentially a curved portion with more flexibility thereof.

16. The electrical connector as claimed in claim 14, wherein a center section extends from said at least one edge section in the vertical direction and is located in said space.

17. An electrical connector comprising:

an insulative housing defining a mating port with a mating opening defined by longitudinal and vertical dimensions thereof;

a plurality of contacts received in the insulative housing;

a shell enclosing the insulative housing and defining at least one edge section around said mating port along a longitudinal direction of said mating port; and a pair of L-shaped spring pieces extending from said at least one edge section under a mirror image arrangement with each other, said spring piece including a linear narrow short section integrally extending from the at least one edge section in a vertical direction, a linear narrow long section integrally extending from a distal end of the short section horizontally spatially along said at least one edge section along said longitudinal direction; wherein a first forwardly extending protrusion is formed around a joint portion of the short section and the long section, and a second forwardly extending protrusion is formed around a distal end of the long section; wherein said short section and said long section have a similar width and thickness so as to assure sufficient resiliency around said first forwardly extending protrusion and said second forwardly extending protrusion.

18. The electrical connector as claimed in claim 17, wherein said pair of spring pieces are distanced from each other along said at least edge section with a space therebetween.

19. The electrical connector as claimed in claim 18, wherein a center section integrally extending from said at least edge section and is located in the space.

* * * * *